US009997033B2

(12) United States Patent
Hyde et al.

(10) Patent No.: US 9,997,033 B2
(45) **Date of Patent: *Jun. 12, 2018**

(54) SYSTEMS AND METHODS FOR MONITORING USE OF RAIL ON A FOOTPATH

(71) Applicant: Elwha LLC, Bellevue, WA (US)

(72) Inventors: Roderick A. Hyde, Redmond, WA (US); Jordin T. Kare, San Jose, CA (US); Elizabeth E. Nugent, Bellevue, WA (US); Elizabeth A. Sweeney, Seattle, WA (US); Charles Whitmer, North Bend, WA (US); Lowell L. Wood, Jr., Bellevue, WA (US)

(73) Assignee: ELWHA LLC, Bellevue, WA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/408,284

(22) Filed: Jan. 17, 2017

(65) Prior Publication Data

US 2017/0124819 A1 May 4, 2017

Related U.S. Application Data

(63) Continuation of application No. 14/624,107, filed on Feb. 17, 2015, now Pat. No. 9,547,975.

(51) Int. Cl.
*G08B 23/00* (2006.01)
*G08B 7/06* (2006.01)
(Continued)

(52) U.S. Cl.
CPC ..... *G08B 7/066* (2013.01); *E04F 11/1802* (2013.01); *G08B 21/22* (2013.01); *E04F 2011/1868* (2013.01)

(58) Field of Classification Search
CPC ..... G08B 7/066; G08B 21/22; E04F 11/1802; E04F 2011/1868
(Continued)

(56) References Cited

U.S. PATENT DOCUMENTS 5,676,215 A 10/1997 Misawa
7,708,117 B2 5/2010 Van Der Heiden
(Continued)

OTHER PUBLICATIONS

Formedia, StairAID, http://stairaid.clientfile.net/, visited Feb. 24, 2015.

(Continued)

*Primary Examiner* — Kerri McNally
*Assistant Examiner* — Thang Tran

(57) ABSTRACT

A safety rail monitoring system, and associated methods of operation, for monitoring use of a safety rail that borders a footpath to help prevent injuries while the user traverses the footpath. The safety system includes a sensor system for detecting the presence of a user on the footpath and the presence of a contact by the user on the safety rail. A sensor observation system in communication with the sensor system receives signals indicating whether the user is present on the footpath and whether the user is holding on to the safety rail. If the user is not holding on to the safety rail, the sensor observation system generates an alert signal to the user to remind the user to hold the safety rail. In some embodiments, the safety system may include a barrier that prevents the user from continuing along the footpath without contacting the safety rail.

40 Claims, 6 Drawing Sheets

(51) Int. Cl.
*G08B 21/22* (2006.01)
*E04F 11/18* (2006.01)

(58) Field of Classification Search
USPC ..... 340/573.1
See application file for complete search history.

(56) References Cited

U.S. PATENT DOCUMENTS 7,950,498 B2 5/2011 Yang et al.
8,146,713 B2 4/2012 Rosenthal
8,365,869 B2 2/2013 Stannah et al.
9,547,975 B2 * 1/2017 Hyde ..... E04F 11/1802
9,792,796 B1 * 10/2017 Lauka ..... G08B 21/02
2003/0127259 A1 7/2003 Logstrup
2007/0004567 A1 1/2007 Shetty et al.
2007/0051562 A1 3/2007 Titchener et al.
2008/0035430 A1 2/2008 Van Der Heiden
2008/0093176 A1 * 4/2008 Rosenthal ..... B66B 9/083 187/241
2008/0264722 A1 * 10/2008 Yang ..... E04F 11/1863 182/15
2009/0309086 A1 * 12/2009 Behan ..... B66B 29/005 256/59
2010/0108443 A1 * 5/2010 Uche ..... E04F 11/1863 182/137
2010/0133045 A1 6/2010 Turina
2010/0192487 A1 * 8/2010 Thornton ..... E04F 11/064 52/183
2010/0274409 A1 10/2010 Smith et al.
2010/0314201 A1 * 12/2010 Stannah ..... B66B 9/08 187/201
2011/0088977 A1 4/2011 Woodhams
2011/0127113 A1 * 6/2011 Vanderburgh ..... B66B 9/0869 187/200
2013/0068566 A1 * 3/2013 Heijns ..... B66B 9/08 187/201
2016/0110981 A1 * 4/2016 Chin ..... G08B 21/02 340/573.1
2016/0110982 A1 * 4/2016 Chin ..... G08B 21/02 340/573.1
2016/0237690 A1 * 8/2016 Hyde ..... E04F 11/1863
2017/0124819 A1 5/2017 Hyde et al.

OTHER PUBLICATIONS

National Center for Biotechnology Information, Performance Evaluation of a Lower Limb Exoskeleton for Stair Ascent and Descent with Paraplegia, http://www.ncbi.nlm.nih.gov/pmc/articles/PMC3691022/, Jun. 24, 2013, visited Feb. 24, 2015, 6 pgs.

* cited by examiner

SYSTEMS AND METHODS FOR MONITORING USE OF RAIL ON A FOOTPATH

CROSS-REFERENCE TO RELATED APPLICATIONS

If an Application Data Sheet ("ADS") has been filed on the filing date of this application, it is incorporated by reference herein. Any applications claimed on the ADS for priority under 35 U.S.C. §§ 119, 120, 121, or 365(c), and any and all parent, grandparent, great-grandparent, etc., applications of such applications, are also incorporated by reference, including any priority claims made in those applications and any material incorporated by reference, to the extent such subject matter is not inconsistent herewith.

The present application claims the benefit of the earliest available effective filing date(s) from the following listed application(s) (the "Priority Applications"), if any, listed below (e.g., claims earliest available priority dates for other than provisional patent applications or claims benefits under 35 USC § 119(e) for provisional patent applications, for any and all parent, grandparent, great-grandparent, etc. applications of the Priority Application(s)).

PRIORITY APPLICATIONS

This application is a continuation of and claims priority to U.S. patent application Ser. No. 14/624,107 (now U.S. Pat. No. 9,547,975) title "SYSTEMS AND METHODS FOR MONITORING USE OF RAIL ON A FOOTPATH, filed on Feb. 17, 2015, which application is hereby incorporated by reference in its entirety.

If the listings of applications provided above are inconsistent with the listings provided via an ADS, it is the intent of the Applicant to claim priority to each application that appears in the Domestic Benefit/National Stage Information section of the ADS and to each application that appears in the Priority Applications section of this application.

All subject matter of the Priority Applications and of any and all applications related to the Priority Applications by priority claims (directly or indirectly), including any priority claims made and subject matter incorporated by reference therein as of the filing date of the instant application, is incorporated herein by reference to the extent such subject matter is not inconsistent herewith.

TECHNICAL FIELD

The field of the present disclosure relates generally to safety systems for a footpath or pathway, and in particular, to such safety systems for monitoring use of a safety rail that borders the footpath to prevent injuries or falls while moving along the footpath.

SUMMARY

The present disclosure describes various embodiments for safety systems and methods of use for monitoring use of a safety rail that borders a footpath (such as a staircase, a ramp, a walkway, a hallway, or other pathway) to help a human user move along the footpath while avoiding potential injury. For example, in one embodiment, the safety system includes a sensor system operatively coupled with the safety rail and the footpath, where the sensor system is configured to detect a presence of the human user within an activation field of the sensor system. The sensor system converts the detected presence into a footpath presence signal. In addition, the sensor system (or a second sensor system) is further configured to detect the presence and/or absence of contact by the user on the safety rail and generate a safety rail contact signal in response to detection or lack of detection. The sensor system may include one or more sensors suitable for detecting the presence of the human user on the footpath and for detecting contact between the user and the safety rail, such as optical sensors, infrared sensors, acoustics sensors, pressure sensors or any other suitable sensor.

In some embodiments, the sensor system may include one or more sensors arranged and supported by the safety rail, where the sensors are configured to detect a touch and/or to detect a grip pressure between the human user and the safety rail. The rail sensors may help determine not only that the user is contacting the safety rail, but also that the user is gripping the safety rail with sufficient strength to properly support the user while walking on the footpath. In such embodiments, contact information detected by the sensors on the safety rail is communicated via the safety rail contact signal.

The footpath presence signal and the safety rail contact signal are communicated to a sensor observation system that is in operative communication with the sensor system. The sensor observation system receives both signals and generates a warning signal or alert signal when the signals indicate that the human is concurrently present on the footpath without contacting the safety rail, or without gripping the safety rail with sufficient grip force above a predetermined force threshold. For example, when the human user begins walking up or down a staircase without immediately (or shortly after entering the staircase) holding on to the safety rail, the warning signal is generated to warn or command the user to hold the safety rail. In some embodiments, the warning signal or alert signal may be a visual signal that the user may perceive or an audible signal or tone that the user may hear. For example, the alert signal may be an synthesized speech (such as a command), a buzzer sound, or a visible light, among other signals.

In some embodiments, the safety system may further include a physical barrier that is movable to block the footpath when the footpath presence and safety rail contact signals indicate that the user is present on the footpath without making contact with the safety rail. The barriers helps ensure that the user cannot walk along footpath (e.g., walk down the stairs) unless the user is contacting or holding on to the rail. When the user contacts the rail, the barrier may retract away to allow the user to continue walking along the footpath. In some embodiments, the barrier may be self-propelled and move along the footpath at a predetermined constant speed or at a speed calculated to match the moving speed of the user along the footpath. In such embodiments, the barrier may serve both as a block to remind the user to hold on to the safety rail before entering the footpath, and as an aid that may be used to physically support the user (e.g., the user may hold on to the barrier) as the user walks along the footpath.

Additional details of these and other embodiments are described further below with reference to the accompanying drawings.

DETAILED DESCRIPTION OF EXAMPLE EMBODIMENTS

Figure 1:
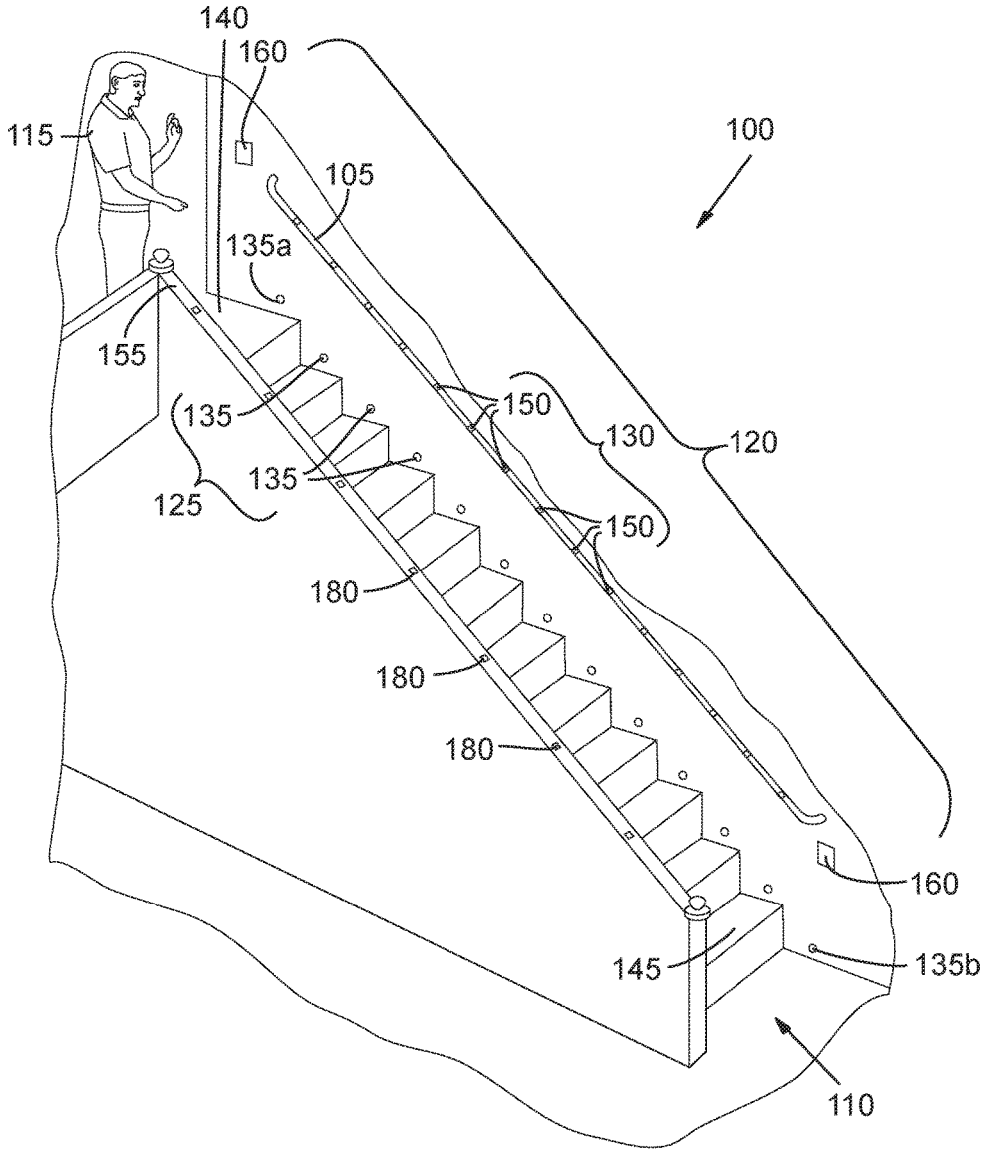
FIG. 1 illustrates a safety rail monitoring system for monitoring a footpath with a plurality of footpath presence sensors, according to one embodiment.

With reference to the drawings, this section describes particular embodiments of various safety systems and their detailed construction and operation. Throughout the specification, reference to "one embodiment," "an embodiment," or "some embodiments" means that a particular described feature, structure, or characteristic may be included in at least one embodiment of the safety system. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

In the following description, the terms "footpath" and "staircase" may be used interchangeably to refer to an example pathway for which the safety system may be used. In addition, the accompany drawings illustrate the footpath as being a staircase in some example embodiments. It should be understood that a staircase is only one example of a footpath that may be monitored with the safety system described below and is not intended to be limiting. The staircase is merely used for illustration purposes in the written description and the accompanying figures.

FIGS. 1-8 collectively illustrate various embodiments of a safety rail monitoring system 100 for monitoring use of a safety rail 105 that borders a footpath 110 to help a user 115 travel along the footpath 110 and avoid tripping or falling while walking on or along the footpath 110. As is discussed in further detail below, the safety rail monitoring system 100 includes a sensor system 120 that monitors the presence of the user 115 along the footpath 110 and determines whether the user 115 is holding on to or contacting a safety rail 105 arranged along the footpath 110. If the sensor system 120 determines that the user 115 is present on the footpath 110 but is not holding or contacting the safety rail 105, then a sensor observation system 160 generates an alert signal or warning to remind the user 115 to hold the safety rail 105 for the safety of the user 115. Upon being alerted, the user 115 may hold the safety rail 105 and continue walking along the footpath 110 to avoid possible injury. As mentioned previously, it should be understood that while the footpath 110 is illustrated as a staircase in the figures, a staircase is only one example of a footpath 110 and not intended to be limiting. In other embodiments, the footpath 110 may be a ramp, a hallway, a walkway, balcony, escalator, overpass, walkway (such as near a fall or a waterway), or any other suitable pathway. The following section describes additional details of these and other embodiments of the safety rail monitoring system 100.

With particular reference to FIG. 1, the safety rail monitoring system 100 includes a sensor system 120 operatively coupled with a safety rail 105 and a footpath 110. The sensor system 120 is configured to detect the presence of the user 115 on the footpath 110, and to detect a contact presence or absence between the user 115 and the safety rail 105 (e.g., to detect whether or not the user 115 is holding on to the safety rail 105). In some embodiments, the sensor system 120 may include a first sensor subsystem 125 operatively coupled to or arranged along the footpath 110, and a second sensor subsystem 130 operatively coupled to the safety rail 105. Both the first and second sensor subsystems 125, 130 may be in communication with one another and share various components, or they may be separate, independent systems.

With reference to FIG. 1, the first sensor subsystem 125 may be coupled to or arranged along the footpath 110 and may comprise one or more individual footpath presence sensors 135. Preferably, at least one footpath presence sensor 135 is positioned near or adjacent an entry of the footpath 110 and at least one other footpath presence sensor 135 at an exit of the footpath 110 to detect the user's 115 approach from either side of the footpath 110. For example, as illustrated in FIG. 1, the footpath sensor 135*a* may be positioned proximal to or at an entry apron 140 (e.g., at an initial step or beginning portion of the staircase), and another footpath presence sensor 135*b* may be positioned proximal to or at an exit apron 145 (e.g., a final step or exit portion) of the footpath 110. In such embodiments, the first sensor subsystem 125 detects the user 115 as the user enters the footpath 110 near the entry apron 140 (e.g., the user begins walking down the staircase), and detects the user 115 at the exit apron 145 when leaving the footpath 110 (e.g., the user walks away from the staircase after reaching the lower level).

As mentioned previously, the first sensor subsystem 125 also includes a plurality of footpath presence sensors 135 positioned along the footpath 110. The footpath presence sensors 135 may be arranged in a variety of configurations along the footpath 110. For example, in one embodiment, the footpath 110 may be a staircase and each stair may include an individual footpath presence sensors 135 coupled to each stair (such as on the risers) or attached adjacent the stair. In some embodiments, a single footpath presence sensor 135 may monitor multiple stairs to reduce the number of total sensors 135 needed to monitor the footpath 110. In other embodiments, the sensors 135 may be positioned underneath the footpath 110 so that they are activated when the user 115 walks on the sensors 135 (e.g., weight sensors). In still other embodiments, the sensors 135 may be arranged in a different configuration, such as distributed at specific distance intervals along a footpath 110 or arranged underneath sections of the footpath 110 (such as weight or pressure sensors). Collectively, these sensors 135 are configured to detect the presence of the user 115 along a travel route extending from the entry apron 140 to an exit apron 145 of the footpath 110. In other words, the sensors 135 detect the user 115 while the user is traveling on the footpath 110, such as when the user is walking up or down the stairs.

Any one of a variety of sensors capable of detecting the presence of the user 115 may be suitable for use. For example, in some embodiments, the footpath presence sensors 135 may include any of the following: optical sensors, acoustic sensors, infrared sensors, photocell sensors, ultrasonic sonar sensors, radar sensors, micro-impulse radar sensors, proximity sensors, pressure sensors/plates, weight sensors, microwave sensors, motion sensors, Doppler sensors, or any other active or passive sensors. It should be understood that in some embodiments, the sensors 135 of the sensor system 120 may not all be of the same kind or type of sensors. For example, the footpath presence sensors 135 near the entry apron 140 and the exit apron 145 may be optical sensors, and the footpath presence sensors 135 on or along the footpath 110 may each be pressure sensors.

Figure 2:
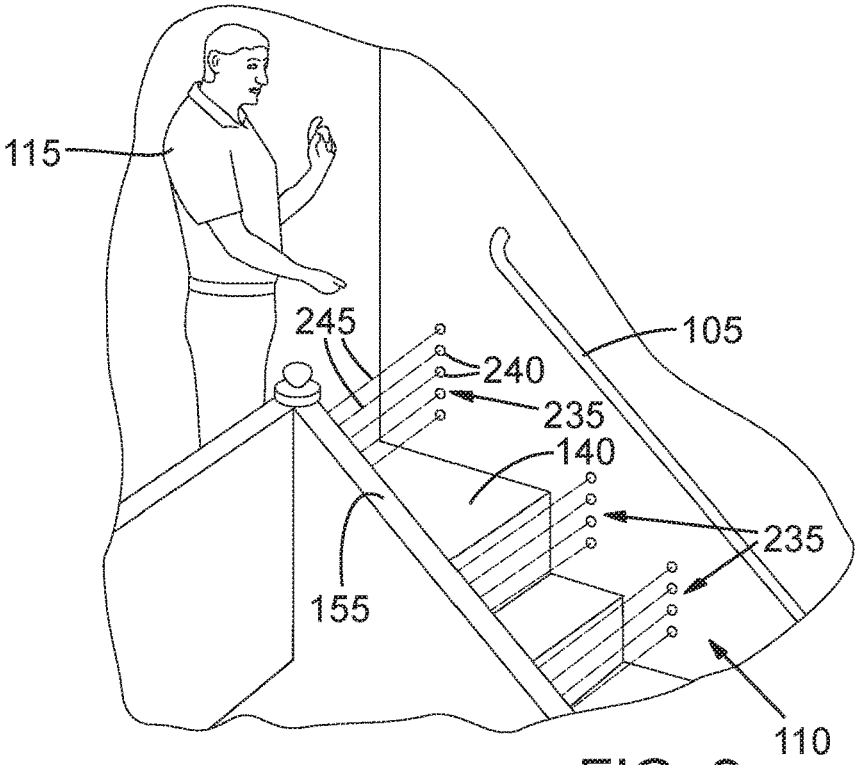
FIG. 2 is a partial cut-away view of the footpath illustrating another embodiment of a safety rail monitoring system, according to another embodiment.

In some embodiments, the footpath presence sensors 135 may include one or more light curtains 235 for monitoring the footpath 110 and detecting the presence of the human user 115 within the footpath 110 (see FIG. 2). With reference to FIG. 2, in one embodiment, a light curtain 235 may be positioned on or near and traversing the entry apron 140 of the footpath 110, and additional light curtains 235 may be on or adjacent individual steps of the footpath 110 and traversing those steps. Although light curtains 235 are illustrated only on portion of the footpath 110, it should be understood that the light curtains 235 may be arranged on each step of the footpath 110, including the exit apron 145, so that each step has a corresponding light curtain. In other embodiments, the light curtains 235 may be arranged in different configurations.

With particular reference to FIG. 2, the light curtains 235 comprise one or more transmitters 240 and receivers (such as photoelectric cells), each of the transmitters 240 projecting one or more light beams 245 toward the receivers (not shown) so that the light beams 245 travel across a width of the footpath 110. Preferably, the light beams 245 are infrared light beams so that they are not visible to the user 115 for aesthetic purposes, but may be other types of light beams. In some embodiments, the light curtains 235 may further include one or more reflectors (not shown) configured to reflect light from one of the transmitters 240 to one or more of the receivers; for example, the receivers and transmitters can both be located on the same side of the footpath, with reflectors placed on the opposite side. When the light curtains 235 are triggered (e.g., a user 115 traverses one or more light beams 245), the sensor system 120 generates the footpath presence signal in response to the human user 115 triggering the light curtains 235. Additional details of these and other embodiments are discussed below.

In some embodiments, the light curtains 235 may be capable of distinguishing between a human user 115 and any other mobile object (such as a pet, ball, toy, etc.) that may be present or moving on the footpath 110 by arranging the light beams 245 at different heights above the footpath 110 and monitoring the light beams 245 that are traversed or interrupted. For example, in one embodiment, the light beams 245 of the light curtain 235 may be arranged so that the topmost light beam 245 is at a height of at least two to three feet and up to eight feet or more above the surface level of the footpath 110 (e.g., as measured from a top surface of the corresponding step). In such embodiments, it is highly likely that when the topmost light beam 245 is interrupted, it signals that a human user 115 is moving in the pathway since a cat, a dog, or other pet likely are not tall enough to interrupt the topmost light beam 245 if it is set at two or three feet. In other embodiments, the topmost light beam 245 may be set at a height of at least three to four feet or higher to minimize the risk that a dog (or a dog's tail) may interrupt the topmost light beam 245. In addition, by tracking and monitoring the interruption of light beams of successive light curtains 235 positioned throughout the footpath 110, the safety rail monitoring system 100 may determine a position, a direction of motion, and a speed of motion of the human user 115 on the footpath 110.

With reference to FIG. 2, the following section briefly describes an example operation process using the light curtains 235. In one example, the sensor system 120 monitors the various light beams 245 of the light curtains 235. When the topmost light beam 245 of the light curtain 235 on the entry apron 140 is triggered, this indicates that a human user 115 has entered the footpath 110 (e.g., a user 115 is going down the stairs). At this point, the sensor system 120 (or the light curtains 235) generates the footpath presence signal indicating that the user 115 has entered the footpath 110. However, if a pet or other object enters the footpath 110, the pet or object may interrupt one or more beams 245 of the light curtains 235, but will likely not interrupt the top most light beam 245. Accordingly, since the topmost light beam 245 is not interrupted, the sensor system 120 will not generate any signal.

Figure 3:
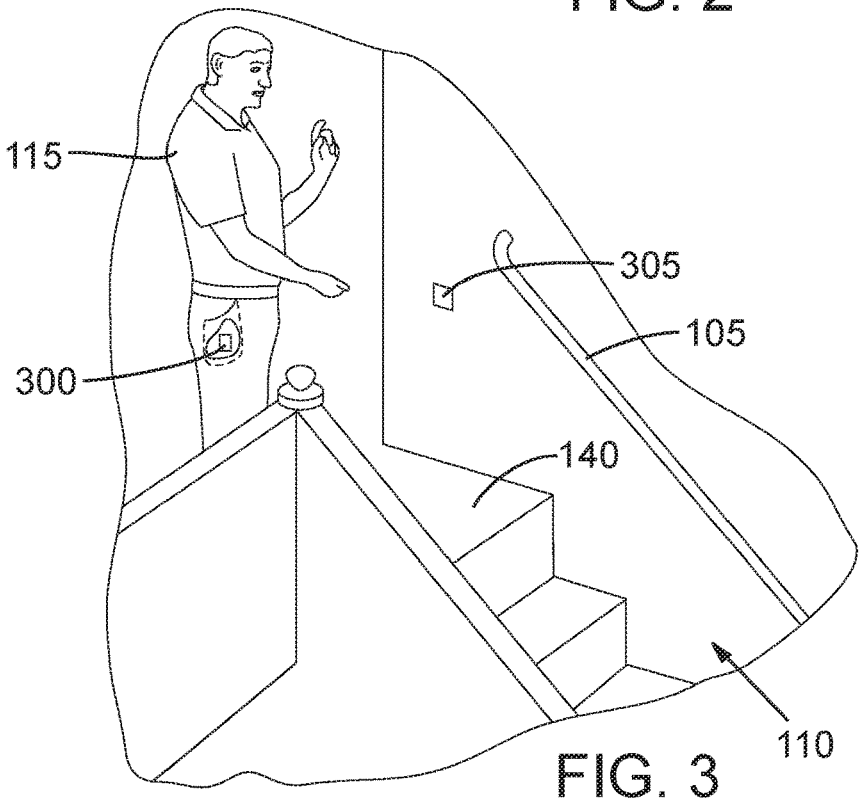
FIG. 3 is a partial cut-away view of the footpath illustrating an automatic identification and data capture system for monitoring the footpath, according to one embodiment.

In other embodiments, the footpath presence sensors 135 may include or comprise an automatic identification and data capture (AIDC) system to automatically detect the user 115 as the user enters the footpath 110. With reference to FIG. 3, the AIDC system may include a tag 300, such as an radio frequency identification (RFID) tag or a tag readable by a machine-vision system, and a tag reader 305, such as an RFID reader configured to detect the RFID tag 300 or a machine-vision system for reading the tag 300. The tag 300 may be carried by the user 115 (such as in a pants pocket, shirt pocket, embedded in clothing worn by the user, or embedded in an electronic device, such as a phone), wherein the tag reader 305 is configured to capture data from the tag 300 to detect the presence of the user 115 within the footpath 110. Preferably, the tag 300 includes identification and other information for its wearer/carrier. For example, the tag 300 carried by the user 115 may include some or all of the following information: (a) the name of the user 115; (b) physical issues or injuries that may impair the user's 115 ability to walk, such as the user's 115 impaired vision, blindness, leg injury, age, etc.; (c) preferences regarding preferred alert signal, such as auditory, visual, spoken commands, etc.; and (d) preferences regarding preferred system settings, such as whether the system should be operative for user 115, what grip strength is required, what fraction of time or travel distance safety rail contact must be maintained, whether or how an existing physical barrier should be operated for user 115, etc.

With reference to FIG. 3, one tag reader 305 may be positioned proximal to the entry apron 140 of the footpath 110, and another tag reader (not shown) may be positioned proximal to the exit apron 145 of the footpath 110 to detect the presence of the tag 300 as the user 115 enters/exits the footpath 110 from either end. In some embodiments, the sensor system 120 may include a plurality of tag readers 305 arranged at various positions along the travel route of the footpath 110 to detect the presence of the tag 300 and position of the user 115 as the user moves along the footpath 110 between the entry and exit aprons 135, 140.

The tag 300 and tag reader 305 may be any one of a variety of suitable devices. For example, in one embodiment, the tag 300 may be a beacon emitting radiation and the tag reader 305 may be a detector for the radiation. The radiation may comprise at least one of ultrasonic radiation, radio frequency radiation, infrared radiation, visible radiation, or ultraviolet radiation. In some embodiments, the tag 300 may be an RFID tag, such as an active RFID tag, and the tag reader 305 may be an RFID reader. The RFID tag may be an active or passive RFID tag, and the RFID reader may be an active or passive RFID reader. Preferably, the RFID reader has a reception range overlapping the footpath 110.

In one embodiment, the RFID tag 300 may be an active RFID tag 300 and the tag reader 305 may be a passive RFID reader 305 configured to receive a signal from the active RFID tag 300. In other embodiments, the RFID tag 300 may instead be a passive RFID tag 300 and the RFID reader 305 may instead be an active RFID reader 305 configured to transmit interrogatory signals and receive data from the passive RFID tag. In yet other embodiments, RFID tag 300 is an active RFID tag 300 and the tag reader 305 is an active reader 305 configured to transmit interrogatory signals, wherein the RFID tag 300 is activated in response to receiving the interrogatory signal.

In some embodiments, the RFID reader 305 may have a fixed interrogatory zone overlapping the footpath 110, where the RFID reader 305 is configured to transmit interrogatory signals within the interrogatory zone and receive data from the RFID tag 300 when the RFID tag 300 is positioned within the interrogatory zone. In such embodiments, the RFID tag 300 may be carried by the human user 115, and the sensor system 120 may generate the footpath presence signal in response to the RFID reader 305 receiving a signal from the RFID tag 300 indicating that the human user 115 is positioned within the interrogatory zone.

In other embodiments, the sensor system 120 may be in communication with smart apparel (e.g., apparel in communication with the sensors of the first sensor system) worn by the user 115 to detect the presence of the user 115 within the footpath 110, and to also detect movement and position information of the user 115. In still other embodiments, the sensor system 120 may be in communication with an electronic device (not shown), such as a mobile phone, personal data assistant (PDA), an electromagnetic transmitter, an ultrasonic transmitter, or other suitable device, carried by the user 115. The electronic device may include a position determination system, such as a GPS or environmental tracking system, configured to generate position information and communicate the information to the first sensor system 120. With this information, the first sensor system 120 may be able to detect the user 115 and track movement of the user 115 through the footpath 110. As is further described in detail with respect to the sensor observation system 160, motion and positional information may be communicated to the sensor observation system 160 to assess whether to provide an alert signal to the user 115.

Figure 4:
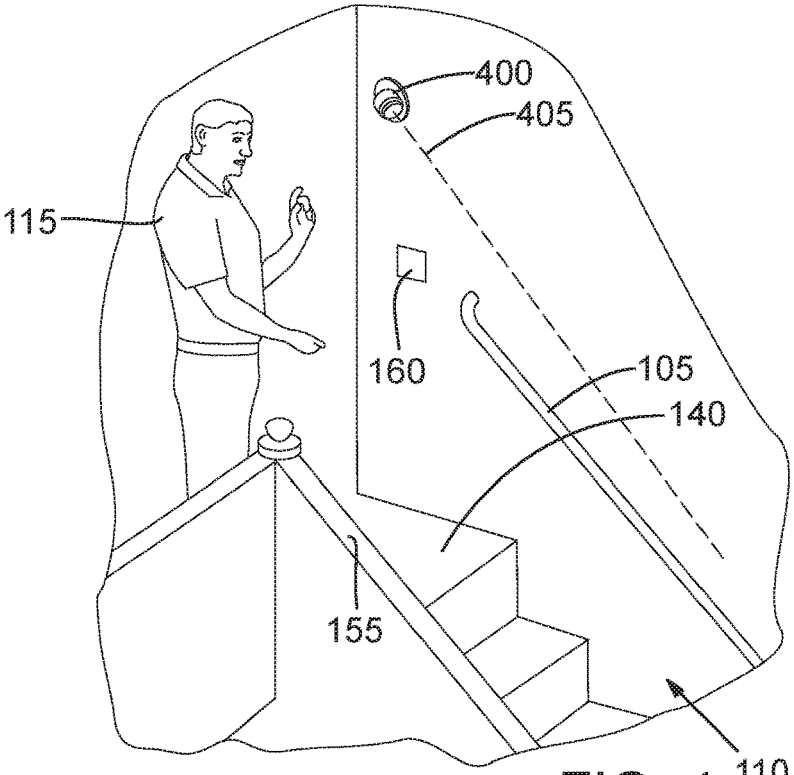
FIG. 4 is a partial cut-away view of the footpath illustrating a camera system for monitoring the footpath, according to one embodiment.

In still other embodiments, the sensor system 120 (or the footpath presence sensor) may be or include a camera system 400 having a field of view 405 overlapping the footpath 110 as illustrated in FIG. 4. With reference to FIG. 4, the camera system 400 is capable of detecting the presence of the user 115 on the entry apron 140 of the footpath 110, the exit apron 145 of the footpath 110, and at any other portion of the footpath 110 as the user 115 is traveling within the footpath 110. Upon detecting the user 115, the camera system 400 may generate the footpath presence signal indicating that the user 115 is located on the footpath 110.

In some embodiments, upon detecting the presence of the user 115, the camera system 400 may capture one or more images of the user 115 to identify the user 115. The identity of the user 115 may determine whether the sensor observation system 160 (described in further detail below) will generate the alert signal notifying the user 115 to hold the safety rail 105 as the user 115 travels along the footpath 110. Such embodiments may be useful in multiple-person households, where only one or two people may be sufficiently young, infirm, or elderly to require assistance by the safety rail monitoring system 100.

In such embodiments, after the camera system 400 obtains the images, the images may be processed via an image processor (not shown) that may be integrated with the camera system 400 or may be part of a remote system (such as a computer) that is in communication with the camera system 400. The image processor processes the images and identifies the user 115 based on the captured images. The camera system 400 may include a database having stored images of all known household members. In such embodiments, the image processor may compare the captured images with the stored images in the database to identify the user 115. Upon identifying the user 115, the camera system 400 communicates the information (such as via the footpath presence signal) to the sensor observation system 160. Based on the information, such as whether the user 115 has been identified as requiring the use or assistance of the safety rail monitoring system 100, the sensor observation system 160 may or may not generate the alert signal to the user 115.

Although the camera system 400 is illustrated in FIG. 4 adjacent the entry apron 140 with a field of view 405 facing generally down the footpath 110, the camera system 400 may include a second camera (not shown) near the exit apron 145 of the footpath 110 having a field of view facing generally up the footpath 110 to ensure that the camera system 400 adequately monitors the entire footpath 110.

In other embodiments, the camera system 400 may instead be a radar system (not shown). Similar to the camera system 400, the radar system may have a field of view overlapping the footpath 110 and comprise at least one of the following: micro-impulse radar, a physically scanned radar, a continuous wave radar, a pulsed radar, a moving target indicator radar, a pulse Doppler radar, a frequency modulated radar, or a phased array radar. The radar system detects movement of the human user 115 within the footpath 110 and obtains images of the user 115. In a similar manner as described previously, the images may be compared to a stored database of images to identify the user 115.

In other embodiments, the sensor system 120 may further detect whether the user 115 is moving along the footpath 110, and may detect the speed and direction of movement of the user 115. For example, with reference to FIG. 1, the footpath 110 may include a plurality of presence sensors 135 as described previously. As the user 115 moves along the footpath 110, the user 115 triggers subsequent sensors 135 along the footpath 110, and based on the time that it takes the user 115 to trigger subsequent sensors 135, the movement speed of the user 115 may be determined by the sensor system 120. In such embodiments, the footpath presence signal generated by the sensors 135 includes an indication of whether the user 115 is in motion on the footpath 110 and the speed at which the user 115 is moving. In other embodiments, such as where the footpath presence sensors 135 include one or more light curtains 235, the speed and/or the direction of motion of the user 115 along the footpath 110 may also be detected by monitoring the interruption of the light beams 245. In still other embodiments, motion of the user 115 may be determined by monitoring a real-time position of the tag 300 (such as via a global positioning system) or by the camera system 400. In some embodiments, the sensor system 120 may detect the direction of travel of the user 115 on the footpath 110. In such embodiments, safety rail monitoring system 100 may employ different settings or alert criteria based on the direction of travel (e.g., whether user 115 is traveling up or down a staircase).

As described previously, the sensor system 120 may include a second sensor subsystem 130 operatively coupled to the safety rail 105 and configured to detect at least one of a contact presence or contact absence between the human and the safety rail 105 and generate a safety rail contact signal. With reference to FIG. 1, the second sensor subsystem 130 may be coupled to or arranged along the safety rail 105 and may comprise one or more individual safety rail sensors 150. Preferably, at least one safety rail sensor 150 is positioned on the safety rail 105 near or adjacent the entry apron 140 of the footpath 110 and at least one other safety rail sensor 150 near or adjacent the exit apron 145 of the footpath 110 to detect the user's 115 approach from either side of the footpath 110. In such embodiments, the second sensor subsystem 130 may detect the user 115 as the user enters the footpath 110 near the entry apron 140 (e.g., the user begins walking down the staircase), and detects the user 115 at the exit apron 145 when leaving the footpath 110 (e.g., the user walks away from the staircase after reaching the lower level).

As mentioned previously, the second sensor subsystem 130 also includes a plurality of safety rail sensors 150 positioned along the safety rail 105 at various points along the footpath 110. The safety rail sensors 150 may be arranged in a variety of configurations along the safety rail 105. For example, in one embodiment, the footpath 110 may be a staircase and the safety rail 105 may include an individual safety rail sensor 150 coupled to the safety rail 105 next to each step in the staircase 110. In other embodiments, a single safety rail sensor 150 may be used for multiple stairs to reduce the number of total sensors 150 needed to monitor the safety rail 105. In still other embodiments, the sensors 150 may be arranged in a different configuration, such as distributed at specific distance intervals along the safety rail 105. Collectively, these sensors 150 are configured to detect the presence or absence of contact from the user 115 on the safety rail 105, and to generate the safety rail contact signal based on whether contact is detected.

In some embodiments, the sensors 150 may be configured to detect the user 115 when the user 115 is in proximity to (e.g., hand hovering near the safety rail 105), but not touching the safety rail 105. In other words, the sensors 150 detect whether the user 115 is touching and/or holding on (or in close proximity) to the safety rail 105 as the user 115 walks along the footpath 110. In other embodiments, the sensors 150 may be further be configured to detect a grip pressure exerted by the user 115 on the safety rail 105 to determine whether the user 115 is properly holding on to the safety rail 105. In such embodiments, the sensors 150 may be able to distinguish between a mere touch or contact by the user 115 and a grip by the user 115 on the safety rail 105.

Any one of a variety of sensors capable of detecting the presence or absence of the user's 115 contact with or proximity to the safety rail 105 may be suitable for use. For example, in some embodiments, the safety rail sensors 150 may include any of the following: optical sensors, acoustic sensors, infrared sensors, photocell sensors, ultrasonic sonar sensors, radar sensors, micro-impulse radar sensors, proximity sensors, pressure sensors/plates, weight sensors, microwave sensors, motion sensors, Doppler sensors, electrical resistivity sensors, capacitance sensors, or any other active or passive sensors. It should be understood that in some embodiments, the sensors 150 may not all be of the same kind or type of sensors.

In some embodiments, the footpath 110 may include more than one safety rail 105. For example, with reference to FIG. 1, the footpath 110 may include a second safety rail 155 bordering an opposite side of the footpath 110 relative to the safety rail 105. The second safety rail 155 may include a plurality of sensors 180 arranged in the same or similar manner as described previously with respect to the sensors 150 of the safety rail 105. In such embodiments, the safety rail sensors 180 may be configured to determine whether the user 115 is contacting the second safety rail 155. In such embodiments, the sensors 180 of the second safety rail 155 may be configured to convert a contact presence (or absence) by the user 115 and generate a second safety rail contact signal and indicate whether the user 115 is contacting the second safety rail 155. If the sensor system 120 determines that the user is not contacting either of the safety rails 105, 155, the sensor observation system 160 may generate an alert signal.

In other embodiments, the sensor system 120 may be further configured to determine whether the user 115 is simultaneously contacting both safety rails 105, 155. In such embodiments, the safety rail 105 may be configured to generate the safety rail contact signal and the second safety rail 155 may be configured to generate a second safety rail contact signal. Based on both of the safety rail contact signals, the sensor observation system 160 may determine whether the user 115 is contacting both safety rails 105, 155 simultaneously and generate an alert signal if the user 115 is not contacting the safety rails 105, 155. Further details regarding the sensor observation system 160 and the alert signal are described below.

In other embodiments, one or both safety rails 105, 155 may include or support both the footpath presence sensors 135 and the safety rail sensors 150, 180 to provide a fully integrated system for simple installation or retrofit. For example, as a person ages, the person may wish to install the safety rail monitoring system 100 in their home. By having both sets of sensors 150, 180 coupled to or supported by the safety rails 105, 150, the person may need only install one or both of the safety rails 105, 150 to border a selected footpath 110, such as a staircase. In other embodiments, the safety rail 105 may be a contact strip that is simply attached to or otherwise coupled with an existing handrail.

Although the first and second sensor subsystems 125, 130 of the sensor system 120 have been described as individual, standalone systems, these systems 120 may share various components and operate in a cooperative. For example, in one embodiment, both the first and second subsystems 125, 130 may initially be in a sleep mode. When the first sensor subsystem 125 detects the presence of the user 115 within its activation field, the first sensor subsystem 125 sends an activation or wake-up signal to activate the second sensor subsystem 130. Once activated, the second sensor subsystem 130, via the safety rail sensors 150, determines whether the user 115 is holding on or contacting the safety rail 105.

As mentioned previously, the sensor system 120 detects whether the user 115 is present on the footpath 110 (via the footpath presence sensors 135) and whether the user 115 is contacting or touching the safety rail 105 (via the safety rail sensors 150). Upon detecting whether the user 115 is present on the footpath 110, and detecting whether the user 115 is holding the safety rail 105, the sensor system 120 generates a footpath presence signal with information about the user's presence on the footpath 110, and a safety rail contact signal with information about whether the user 115 is contacting the safety rail 105. These signals are received by the sensor observation system 160, which is configured to generate an alert signal based on the footpath presence and safety rail contact signals indicating that the user 115 is concurrently present on the footpath 110 without contacting the safety rail 105. Further details of the sensor observation system 160 are discussed below with particular reference to FIGS. 1 and 5.

As described previously, the sensor observation system 160 receives the signals from the sensor system 120 and if the user 115 is not holding the safety rail 105, the sensor observation system 160 warns or alert signals the user 115 that the user 115 should grip or otherwise hold on to the safety rail 105 while walking along the footpath 110. In some embodiments, the sensor observation system 160 will not generate an alert signal unless the footpath presence signals and/or the safety rail signals received from the sensor system 120 indicate that the user 115 is in motion on the footpath 110 without contacting the safety rail 105. If the user 115 is not in motion (e.g., the user 115 walked up to the entry apron 140 but did not continue walking along the footpath 110), the sensor observation system 160 may not generate alert signal.

Figure 5:
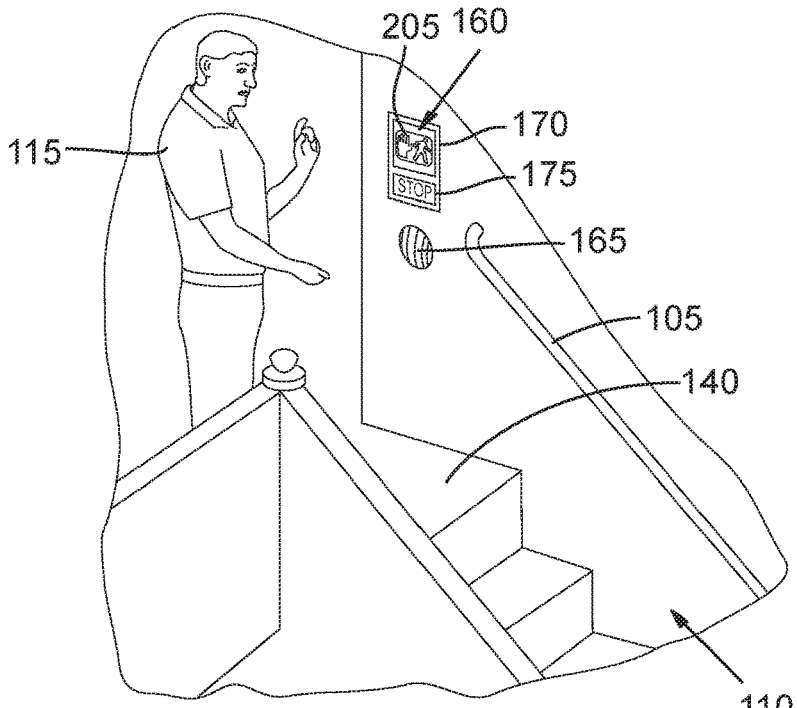
FIG. 5 is a partial cut-away view of the footpath illustrating one embodiment of a sensor observation system for communicating an alert signal to the user.

With reference to FIG. 5, the warning signal or alert signal generated by the sensor observation system 160 may be any suitable signal that warns the user 115 to hold the safety rail 105. For example, the alert signal may be (a) an audible signal or tone, such as a buzzer, beep, or an alarm; (b) synthesized speech or a spoken message (e.g., a command to stop, a command to hold the safety rail, or any other command), or (c) any other signal heard by the user delivered through a speaker system 165. The warning signal may additionally, or alternatively include, a visual signal perceived by the user 115, such as a person walking (when it is safe to travel on the footpath 110) or a hand (when an object is present on the footpath 110), or any other signals, including signals commonly seen on pedestrian crosswalks. The visual signal may be presented to the user 115 on a display screen 170 and may include a textual message 175 and/or a graphic image warning the user 115 to stop and hold on to the stair rail 105 before continuing to walk along the footpath 110.

In some embodiments, the speaker system 165 and/or the display screen 170 may mounted near the entry apron 140 of the pathway 110 (e.g., on a top or beginning step of the staircase) for easy reference or viewing by the user 115. Since injury may be more likely and/or more severe if one were to fall going down the stairs rather than fall while walking up the stairs, it is preferable that the sensor observation system 160 (and in particular the display screen 170 and/or speaker 165) is positioned near the entry apron 140 of the staircase 110. In other embodiments, the sensor observation system 160 may be positioned both at the entry apron 140 and the exit apron 145 (e.g., the bottom step) of the footpath 110. In still other embodiments, the speaker 165 and the display screen 170 may be positioned at other points along the footpath 110 so that the sensor observation system 160 may still effectively warn the user 115 to hold the safety rail 105 at any point along the footpath 110.

Figure 6:
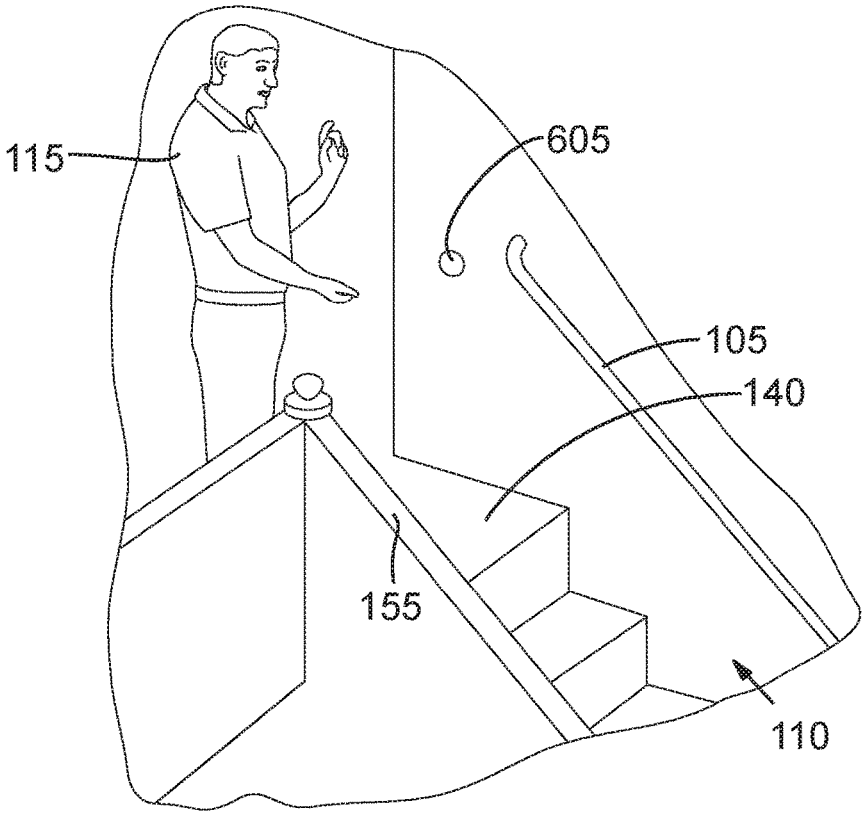
FIG. 6 is a partial cut-away view of the footpath illustrating another embodiment of a sensor observation system.
Figure 7:
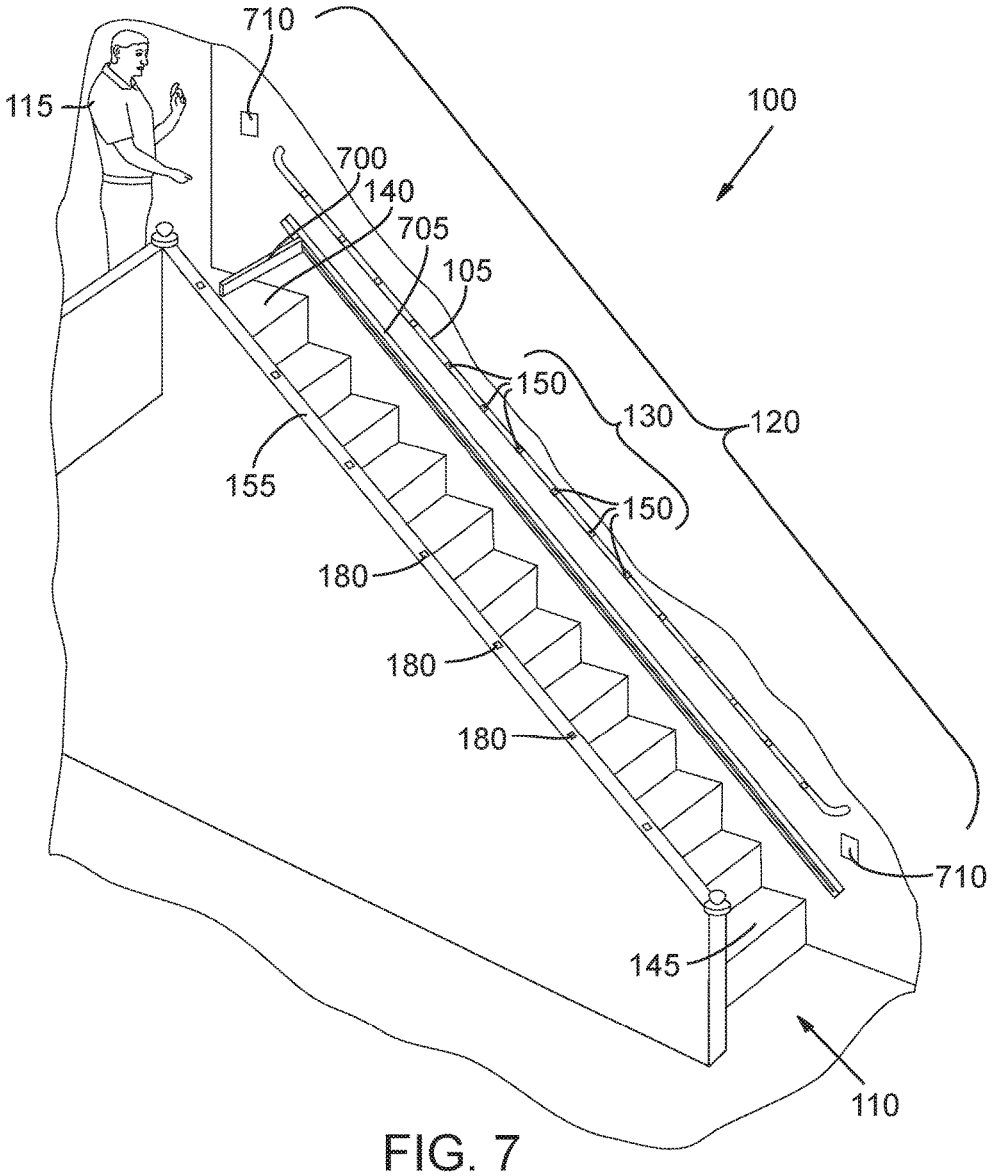
FIG. 7 illustrates a moveable barrier positioned along the footpath for impeding progress of the user along the footpath, according to one embodiment.

In other embodiments, the visual signal may simply be a visible light source that alert signals the user 115 to hold on to the safety rail 105. With reference to FIG. 6, a light-emitting diode (LED) 605 or other light source may be mounted adjacent both the entry apron 140 and the exit apron 145 of the footpath 110 (and at various other positions along the footpath 110). When the user 115 is contacting the safety rail 105 with an appropriate grip force that the sensor system 120 determines to be sufficient for supporting the user 115, the LED 605 may be green, indicating that the user 115 may continue along the footpath 110. If, on the other hand, the user 115 is not contacting the safety rail 105, or is not exerting sufficient grip force on the safety rail 105, the LED 605 may be red to warn the user 115 to touch and hold the safety rail 105 before continuing on the footpath 110.

In some embodiments, the safety rail monitoring system 100 may include an output device (not shown), such as a small radio, a mobile phone, or other electronic device, that is carried or worn by the user 115 and is in wireless communication with the sensor observation system 160. In such embodiments, the audible signal may be communicated from the sensor observation system 160 through the output device so that the user 115 can hear the signal. In some instances, the warning signal may include a vibratory signal where the output device (e.g., a mobile phone) vibrates so that the user 115 can feel it and remember to hold on to the safety rail 105.

In other embodiments, the output device may include a phone, computer, or other device worn or carried by a caregiver tasked with caring for the user 115. The alert signal may be transmitted to the output device to alert the caregiver that the user 115 is on the footpath 110 and not contacting the safety rail(s) 105, 155. The caregiver may thereafter approach the footpath 110 to ensure that the user 115 is safe and holding the safety rail(s) 105, 155.

In some embodiments, the safety rail monitoring system 100 may be in communication with an external device (not shown), such as a computer or other database. The safety rail monitoring system 100 may be further configured to transmit a progress signal to the external device to track statistics for the user's 115 regarding a number of times the user 115 travels along the footpath 110 and the propensity of the user 115 to contact and hold the safety rail(s) 105, 155. The progress signal may be one or a combination of: the footpath presence signal, the safety rail contact signal, the alert signal, or a different signal. With this information, the user 115, the user's 115 family, or a caregiver may track the user's 115 progress and determine a corrective course of action for the user's 115 safety if needed. For example, if the user 115 is not consistently holding on to safety rail(s) 105, 155 as the user 115 traverses the footpath 110, then the caregiver or family members may discuss this with the user 115 and take additional steps to ensure the user's 115 safety (such as by implementing a barrier 700 discussed in further detail below with reference to FIG. 7).

In some embodiments, the alert signal generated by the sensor observation system 160 may be based on a time duration for which the footpath presence signal and the safety rail contact signal(s) indicate that the human is concurrently present on the footpath 110 without making contact with one or both of the safety rails 105, 155. For example, if the sensor system 120 detects the user 115 within the footpath 110 for a predetermined amount of time (for example, five seconds, ten seconds, fifteen seconds, or any other suitable time period) without the user 115 making contact with one or both of the safety rails 105, 155, then the sensor system 120 may generate the footpath presence signal and the safety rail contact signal and transmit the signals to the sensor observation system 160 to generate the alert signal. If the user 115 is present within the footpath 110 and contacts the safety rail(s) 105, 155 within the predetermined amount of time, then no alert signal is generated. For example, the sensor observation system may permit user 115 to have short periods of no-or-poor safety rail contact as long as adequate contact is resumed within a specified time period.

In other embodiments, the alert signal generated by the sensor observation system 160 may be based on a travel distance and/or a travel direction of the user 115 (such as measured from the entry apron 140 or the exit apron 145 of the footpath 110) for which the footpath presence signal and the safety rail contact signal indicate that the user 115 is concurrently present on the footpath 110 without making contact with the safety rail(s) 105, 155. As mentioned previously, the sensor system 120 is configured to determine a location of the user 115 on the footpath 110. In such embodiments, the sensor system 120 may further generate a user presence location signal to indicate a location of the user 115 on the footpath 110, and transmit the user presence location signal to the sensor observation system 160. In some embodiments, the safety rail sensors 150 may be further configured to detect a location of the contact between user and the safety rail(s) 105, 155 and generate a safety rail contact location signal indicating a position along the safety rail(s) 105, 155 at which the user 115 is making contact.

Based on one or both of the user presence location signal and the safety rail contact location signal, the sensor system 120 (or the observation system 160 or other system of the safety rail monitoring system 100) may determine whether the user 115 has crossed a threshold distance relative to the entry and exit aprons 140, 145 after which the sensor observation system 160 generates the alert signal if the footpath presence signal and the safety rail contact signal(s) indicate that the user 115 is not contacting the safety rails 105, 155. In some embodiments, the sensor observation system 160 may generate the alert signal based on one or both of the travel distance and the travel direction of the user 115 on the footpath 110 (e.g., whether the user 115 is walking up or down the staircase 110).

In other embodiments, the alert signal may be provided at a location on the footpath 110 based on the user presence location signal to optimize the likelihood that the user 115 will hear or see the alert signal as the user moves along the footpath 110. For example, as described previously, a plurality of electronic or other devices (e.g., speakers, displays, illumination sources, etc.) may be distributed along the footpath 110. In such embodiments, the alert signal may be delivered to the closest device relative to the user 115 based on a location of the user as determined by the user presence location signal.

In other embodiments, the sensor system 120 may be configured to distinguish between multiple users 115 on the footpath 110 and determine whether some or all of the users 115 are contacting the safety rail 105. For example, the sensor system 120 may be configured to determine a location for each of the multiple users 115 on the footpath 110 and a location of one or more distinct contact points on the safety rail 105 corresponding to each user 115. The sensor system 120 may be configured to generate the user presence location signal indicating a location of each user 115 on the footpath 110, and a safety rail contact location signal indicating a location of one or more distinct contact points on the safety rail 105 by the users 115. The sensor observation system 160 (or other system of the safety rail monitoring system 100) receives the user presence location signal and the safety rail contact location signal and determines the number and location of users 115 present on the footpath 110 and the number and location of distinct contact points on the safety rail 105. The sensor observation system 160 thereafter determines whether the location of each of the users 115 matches a corresponding location for a detected contact point on the safety rail 105. If all the users 115 are contacting the safety rail 105, the number of detected users 115 will be equal to the number of detected distinct contact points on the safety rail 105, with the location of each contact point on the safety rail 105 matching a corresponding location of an individual user 115 on the footpath 110. If the number of detected users 115 on the footpath 110 exceeds the number of detected contact points on the safety rail 105, then the sensor observation system 160 generates an alert signal indicating that one or more users 115 is not contacting the safety rail 105. Additional details regarding the sensor observation system 160 and the alert signals are described below in further detail.

In another embodiment, in addition to warning the user 115 to hold on to the safety rail 105, the safety rail monitoring system 100 or the sensor observation system 160 may further be configured to prevent the user 115 from traveling on the footpath 110 without making contact with the safety rail 105. For example, with reference to FIG. 7, the safety rail monitoring system 100 may further include a barrier 700 positioned proximal to the entry apron 140 to impede the progress of the user 115 on the footpath 110. The barrier 700 may be a boom barrier or other physical structure that blocks the footpath 110 upon the sensor observation system 160 receiving the footpath presence signal and the safety rail contact signals that indicate that the user 115 is present on the footpath 110 without making contact with the safety rail 105. Once the user 115 contacts the safety rail 105, the barrier 700 may move out of position to allow the user 115 to move along the footpath 110.

In some embodiments, the barrier 700 may be self-propelled and move along a track 705 extending next to the footpath 110 and the safety rail 105. As mentioned previously, the sensor system 120 is configured to determine a movement speed of the user 115 along the pathway 110. In such embodiments, the sensor system 120 may communicate the speed and movement information of the user 115 to the barrier 700. With this information, the barrier 700 may then determine an appropriate movement speed (which may be approximately equal to the movement pace/speed of the user 115 or may be approximately 5-10% or more faster), at which to move along or next to the safety rail 105. As long as the user 115 maintains contact with the safety rail 105, the barrier 700 continues moving on the track 705 until reaching the exit apron 140, at which point, the barrier 700 may pivot out of position to avoid blocking the footpath 110. If the user 115 releases the safety rail 105 or fails to exert an adequate grip force thereon, the barrier 700 may stop and the sensor observation system 160 may alert or warn the user 115 to hold the safety rail 105. The barrier 700 may remain stopped until the user 115 contacts the safety rail 105.

In some embodiments, once the barrier 700 has reached the exit apron 145, the barrier 700 may remain at that position until the user 115 once again walks on the footpath 110, at which point the barrier 700 will move from the exit apron 145 toward the entry apron 140 ahead of the user 115. In other embodiments, the barrier 700 may automatically return to the entry apron 140 after reaching the exit apron 145 and allowing the user 115 to exit the footpath 110. For example, the barrier 700 may move only after a predetermined amount of time has elapsed to allow the user 115 to clear the footpath 110. In still other embodiments, the barrier system 750 may include a call button 710 positioned next to one or both the entry apron 140 and the exit apron 145 so that the barrier 700 may be called from its position toward the user 115. For example, in embodiments where multiple users may be using the safety rail monitoring system 100, if a first user walks down the footpath (e.g., the staircase of FIG. 7), the barrier 700 remains at the exit apron 145. If a second user approaches the entry apron 140, the second user may press the call button 710 to return the barrier 700 back up the stairs to support the second user. In still other embodiments, the sensor system 120 may sense the user 115 near the entry apron 140 or the exit apron 145 of the footpath 110 and automatically move the barrier 700 to the user's position.

In some embodiments, the safety rail monitoring system 100 may include an input system (not shown) configured to receive input or programming instructions from one or more users to program or control various parameters of the safety rail monitoring system 100. For example, the input system may be used to activate or deactivate any of the sensors of the sensor system 120, the barrier 700, or any other components of the monitoring system 100, as desired. In other embodiments, the input system may be used to program various aspects of the AIDC system, including the tag 300 and the tag reader 305, such as identifying the number of users carrying a tag, assigning unique identification frequencies for each of the users so the system 100 can distinguish between the users, and/or defining the interrogatory zone of the tag reader.

The input system may also be used to allow the users to program the monitoring system 100 to best serve the needs of the various users, such as in a multiple-user household. The input system may receive user information, such as height, weight, age, or other parameters that may be used by the various sensors of the system 100 to identify the users while on the footpath 110. In some cases, certain users may not need to hold on to the safety rails 105, 155 or use the barrier 700, such as for younger users in good physical condition. For those users, the input system may be used to program the monitoring system 100 to ignore when those users are in the footpath 110 or to automatically move the barrier 700 out of position to allow the user free access to the footpath 110. As those users age, or if they suffer an injury or otherwise need the monitoring system 100 in the future, the input system may be used to reactivate those users as needed. In other embodiments, the input system may be used to control other features of the monitoring system 100.

Figure 8:
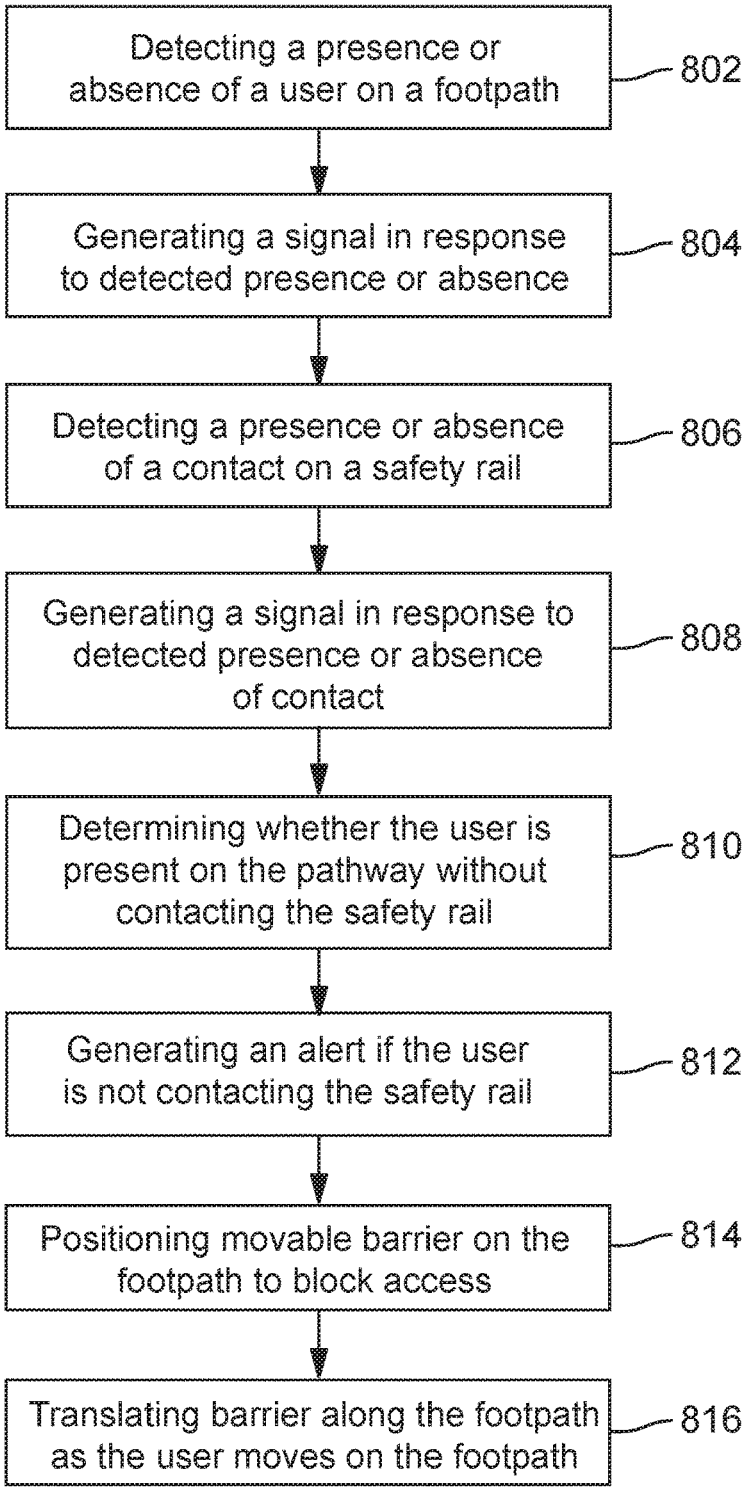
FIG. 8 is a block diagram illustrating a method for monitoring use of a safety rail bordering a footpath, according to one embodiment.

FIG. 8 is a block diagram illustrating a method for monitoring use by a human of a safety rail that borders a footpath. It should be understood that the method described below is for illustration purposes and the order in which the steps are described is not meant to be limiting. It should be understood that in other embodiments, the steps may occur in a different order.

With particular reference to FIG. 8, at step 802, the footpath presence sensor detects a presence of a user on the footpath. In some embodiments, the footpath presence sensor may also determine a movement speed and movement direction of the user along the footpath. In some embodiments, the presence of the user and the movement speed and direction may be determined by communication of the footpath presence sensor with an electronic device (such as a mobile phone) having a position determination system (e.g., GPS), where the electronic device is carried or worn by the user. At step 804, the footpath presence sensor generates a footpath presence signal in response to detecting the presence of the user in the footpath.

At step 806, the safety rail sensor detects a contact presence or contact absence of a contact between the user and a safety rail. In other words, the safety rail sensors detect whether the user is holding on to the safety rail. As mentioned previously, in some embodiments, the safety rail sensors may also determine a grip pressure that the user is exerting on the safety rail to determine whether the user has an adequate grip on the safety rail. Thereafter, at step 808, the safety rail sensor generates a safety rail contact signal in response to the detected contact presence or absence on the safety rail.

At step 810, the sensor observation system (or other system of the safety rail monitoring system) receives both the footpath presence signal and the safety rail contact signal and determines whether the user is concurrently present on the footpath without making contact with the safety rail. If the signals indicate that the user is not making contact with the safety rail, at step 812, the sensor observation system generates a warning or alert signal communicating to the user that the user must hold on to the safety rail before continuing along the footpath. The alert signal may be an audible signal or tone, such as synthesized speech (e.g., a command to stop or to hold the safety rail) or a buzzer, or the alert signal may be a visual signal, such as a graphic image, text, or visible light. When the user receives the alert signal, the user may thereafter contact and hold the safety rail to continue walking along the footpath without receiving further warnings.

In some embodiments, the sensor observation system may be further configured to prevent the user from traveling on the footpath without making and maintaining contact with the safety rail. In such embodiments, after the sensor observation system generates and sends the warning signal to communicate to the user to hold the safety rail, the sensor observation system (or other system) at step 814 erects or positions a movable barrier to block the footpath upon concurrent receipt of footpath presence and safety rail contact signals that indicate that the human is present on the footpath without making contact with the safety rail. As described previously, in some embodiments, the movable barrier may be a self-propelled, boom barrier positioned proximal to the entry apron of the footpath. At step 816, the movable barrier may be translated along the safety rail at a movement pace substantially matching the user's movement pace along the footpath. The movable barrier may continue moving along the safety rail as long as the user maintains continuous contact with the safety rail.

Other embodiments are possible. Although the description above contains much specificity, these details should not be construed as limiting the scope of the invention, but as merely providing illustrations of some embodiments of the invention. It should be understood that subject matter disclosed in one portion herein can be combined with the subject matter of one or more of other portions herein as long as such combinations are not mutually exclusive or inoperable.

The terms and descriptions used above are set forth by way of illustration only and are not meant as limitations. Those skilled in the art will recognize that many variations can be made to the details of the above-described embodiments without departing from the underlying principles of the invention.

The invention claimed is:

1. A safety rail monitoring system for monitoring use of a safety rail that borders a footpath, comprising:

a sensor system configured to detect a presence of a human on the footpath and to detect a contact presence between the human and the safety rail when the human is present on the footpath; and a sensor observation system in operative communication with the sensor system, the sensor observation system configured to generate an alert signal when the human is concurrently present on the footpath without contacting the safety rail.

2. The safety rail monitoring system of claim 1, wherein the sensor system includes a footpath presence sensor that detects the presence of the human on the footpath and generates a footpath presence signal, and a safety rail sensor that detects at least one of a contact presence or a contact absence between the human and the safety rail and generates a safety rail contact signal.

3. The safety rail monitoring system of claim 2, wherein the footpath presence signal includes an indication of whether the human is in motion on the footpath.

4. The safety rail monitoring system of claim 2, wherein the sensor observation system generates the alert signal upon receipt of a combination of the footpath presence signal and the safety rail contact signal that indicates that the human is in motion on the footpath without contacting the safety rail.

5. The safety rail monitoring system of claim 2, wherein the footpath presence sensor is configured to detect the presence of the human along a travel route extending from an entry apron to an exit apron of the footpath.

6. The safety rail monitoring system of claim 1, wherein the sensor system is further configured to determine an identity of the human.

7. The safety rail monitoring system of claim 6, where the sensor observation system selectively generates the alert signal further based on the identity of the human.

8. The safety rail monitoring system of claim 7, further comprising an input system in communication with the sensor observation system, the input system configured to receive input for associating the alert signal with the identity of the human.

9. The safety rail monitoring system of claim 1, further comprising a barrier movable to block the footpath upon detection that the human is present on the footpath without making contact with the safety rail.

10. The safety rail monitoring system of claim 9, further comprising an input system in communication with the barrier, the input system configured to receive control parameters for operating the barrier and to operate the barrier based on the control parameters.

11. The safety rail monitoring system of claim 1, wherein the sensor system is further configured to detect a location of the human presence on the footpath and to generate a human presence location signal.

12. The safety rail monitoring system of claim 11, wherein the alert signal is provided at a location based on the human presence location signal.

13. The safety rail monitoring system of claim 11, wherein the alert signal is generated based on a direction of human travel on the footpath.

14. The safety rail monitoring system of claim 1, wherein the sensor system is further configured to wirelessly transmit a progress signal to an external device to track the user's propensity for contacting the safety rail while on the footpath.

15. A safety rail monitoring system for monitoring use of a safety rail that borders a footpath, comprising:

a sensor system operatively coupled with the safety rail and the footpath, the sensor system configured to detect a presence of a human on the footpath, the sensor system including a safety rail sensor configured to detect a contact presence between the human and the safety rail and generate a safety rail contact signal when detecting the contact presence; and in operative communication with the sensor system, a sensor observation system that generates an alert signal upon receipt of the safety rail contact signal that indicates that the human is concurrently present on the footpath without making contact with the safety rail.

16. The safety rail monitoring system of claim 15, wherein the sensor system detects whether the human is in motion on the footpath.

17. The safety rail monitoring system of claim 16, wherein the sensor observation system generates the alert signal when the sensor system detects that the human is in motion on the footpath without making contact with the safety rail.

18. The safety rail monitoring system of claim 16, wherein the sensor system is configured to detect the presence of the human along a travel route extending from an entry apron to an exit apron of the footpath.

19. The safety rail monitoring system of claim 15, wherein the sensor system is further configured to determine an identity of the human.

20. The safety rail monitoring system of claim 19, where the sensor observation system selectively generates the alert signal further based on the identity of the human.

21. The safety rail monitoring system of claim 19, further comprising an input system in communication with the sensor observation system, the input system configured to receive input for associating the alert signal with the identity of the human.

22. The safety rail monitoring system of claim 15, further comprising a barrier movable to block the footpath upon detection that the human is present on the footpath without making contact with the safety rail.

23. The safety rail monitoring system of claim 22, further comprising an input system in communication with the barrier, the input system configured to receive control parameters for operating the barrier and to operate the barrier based on the control parameters.

24. The safety rail monitoring system of claim 15, wherein the sensor system is further configured to detect a location of the human presence on the footpath and to generate a human presence location signal.

25. The safety rail monitoring system of claim 24, wherein the alert signal is provided at a location based on the human presence location signal.

26. The safety rail monitoring system of claim 24, wherein the alert signal is generated based on a direction of human travel on the footpath.

27. The safety rail monitoring system of claim 15, wherein the sensor system is further configured to wirelessly transmit a progress signal to an external device to track the user's propensity for contacting the safety rail while on the footpath.

28. A safety rail monitoring method for monitoring use by a human of a safety rail that borders a footpath, the method comprising:

detecting a presence of a human on the footpath with a footpath presence sensor;

detecting a presence of a contact between the human and the safety rail with a safety rail sensor;

generating, via the safety rail sensor, a safety rail contact signal in response to detection of the contact between the human and the safety rail; and generating an alert signal upon receipt of the safety rail contact signal that indicates the human is concurrently present on the footpath without making contact with the safety rail.

29. The safety rail monitoring method of claim 28, further comprising generating an indication of whether the human is in motion on the footpath with the footpath presence sensor.

30. The safety rail monitoring method of claim 28, further comprising generating the alert signal upon receipt of a combination of the footpath presence signal and the safety rail contact signal that indicates that the human is in motion on the footpath without making contact with the safety rail.

31. The safety rail monitoring method of claim 28, wherein the footpath presence sensor is configured to detect the presence of the human along a travel route extending from an entry apron to an exit apron of the footpath.

32. The safety rail monitoring method of claim 28, further comprising determining, via the sensor system, an identity of the human.

33. The safety rail monitoring method of claim 32, further comprising selectively generating, via the sensor observation system, the alert signal further based on the identity of the human.

34. The safety rail monitoring method of claim 28, further comprising an input system in communication with the sensor observation system, the method further comprising receiving, via the input system, input for associating the alert signal with the identity of the human.

35. The safety rail monitoring method of claim 28, further comprising a barrier movable to block the footpath upon detection that the human is present on the footpath without making contact with the safety rail.

36. The safety rail monitoring method of claim 35, further comprising an input system in communication with the barrier, the method further comprising receiving, via the input system, control parameters for operating the barrier, and operating the barrier based on the control parameters.

37. The safety rail monitoring method of claim 28, further comprising detecting, via the sensor system, a location of the human presence on the footpath and generating a human presence location signal.

38. The safety rail monitoring method of claim 37, wherein the alert signal is provided at a location based on the human presence location signal.

39. The safety rail monitoring method of claim 37, wherein the alert signal is generated based on a direction of human travel on the footpath.

40. The safety rail monitoring method of claim 28, further comprising, wirelessly transmitting, via the sensor system, a progress signal to an external device to track the user's propensity for contacting the safety rail while on the footpath.

* * * * *